US010236114B2

(12) United States Patent
Xu et al.

(10) Patent No.: US 10,236,114 B2
(45) Date of Patent: Mar. 19, 2019

(54) TRANSFORMER FOR AN ELECTRIC CONNECTOR

(71) Applicant: FOXCONN INTERCONNECT TECHNOLOGY LIMITED, Grand Cayman (KY)

(72) Inventors: Yong-Chun Xu, Kunshan (CN); Ming-Sheng Su, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/593,676

(22) Filed: May 12, 2017

(65) Prior Publication Data

US 2017/0330679 A1 Nov. 16, 2017

(30) Foreign Application Priority Data

May 13, 2016 (CN) ..... 2016 2 0430744 U

(51) Int. Cl.

| | |
|---|---|
| ***H01F 27/29*** | (2006.01) |
| ***H01F 27/28*** | (2006.01) |
| ***H01F 27/24*** | (2006.01) |
| ***H01F 19/04*** | (2006.01) |

(52) U.S. Cl.

CPC ..... *H01F 27/2823* (2013.01); *H01F 19/04* (2013.01); *H01F 27/24* (2013.01); *H01F 27/2895* (2013.01); *H01F 27/29* (2013.01)

(58) Field of Classification Search

CPC ..... H01F 27/2823; H01F 27/24; H01F 27/29; H01F 27/2895; H01F 19/04; H01F 17/062; H01F 17/06; H01F 2017/0093; H01F 41/07

USPC ..... 336/220, 229, 170, 192, 184, 222

See application file for complete search history.

(56) References Cited

U.S. PATENT DOCUMENTS

| | | | | |
|---|---|---|---|---|
| 9,502,829 | B2 | 11/2016 | Chen | |
| 9,633,774 | B2 | 4/2017 | Xu et al. | |
| 2007/0040645 | A1 | 2/2007 | Sedio | |
| 2012/0322309 | A1* | 12/2012 | Xu | H01F 17/062 439/620.06 |
| 2014/0266536 | A1* | 9/2014 | Lu | H01F 27/2895 336/178 |
| 2016/0329147 | A1* | 11/2016 | Fan | H01F 27/29 |

FOREIGN PATENT DOCUMENTS

| | | |
|---|---|---|
| CN | 105703155 | 6/2016 |
| WO | 2010045578 | 4/2010 |

* cited by examiner

*Primary Examiner* — Mang Tin Bik Lian

(74) *Attorney, Agent, or Firm* — Wei Te Chung; Ming Chieh Chang

(57) ABSTRACT

A transformer (100) includes a magnetic core (1), a primary coil (2), and a secondary coil (3) wound around the magnetic core (1), the primary coil including a first enameled wire (21) and a second enameled wire (22), one end of the first enameled wire and one end of the second enameled wire forming a first center tap (23) twisted into a bundle, the secondary coil including a third enameled wire (31) and a fourth enameled wire (32), one end of the third enameled wire and one end of the fourth enameled wire forming a second center tap (33) twisted into another bundle, the transformer (100) having only four enameled wires and the first center tap (23) is cross with the second center tap (33).

1 Claim, 8 Drawing Sheets

TRANSFORMER FOR AN ELECTRIC CONNECTOR

BACKGROUND OF THE INVENTION

1. Field of the Invention

The present disclosure relates to a transformer for an electric connector used for filter circuits of 2.5 Gbps or 5 Gbps Ethernet networks.

2. Description of Related Arts

U.S. Pat. No. 9,502,829, issued on Nov. 22, 2016, discloses a transformer including a first wire group and a second wire group each having four wires. Due to the excessive number of wires, it's not suitable for 2.5 Gbps or 5 Gbps Ethernet applications. U.S. Pat. No. 9,633,774, issued on Apr. 25, 2017, discloses a transformer where a center tap of a primary coil and a center tap of a secondary coil are intercrossed to improve high frequency characteristics.

WO 2010/045578, published on Apr. 22, 2010, discloses a transformer including a group of four wires each covered with a thin, color-coded insulator. The four wires are twisted together in a repeating pattern of a red wire, a natural or copper-colored wire, a green wire, and a blue wire. Coupling of the primary and secondary sides of the transformer may be controlled in a consistent manner through the use of a retention twist. Besides, the red and green final twist wires may have their insulation stripped therefrom so that they are interconnected together as a center tap of the transformer circuit. Likewise, the blue and natural final twist wires may also have their insulation stripped therefrom so that they are interconnected together as a center tap of the secondary circuit of the transformer.

SUMMARY OF THE INVENTION

Accordingly, an object of the present invention is to provide an improved transformer.

To achieve the above object, a transformer comprises: a magnetic core; a primary coil wound around the magnetic core and comprising a first enameled wire and a second enameled wire, one end of the first enameled wire with one end of the second enameled wire forming a first center tap, the first center tap twisted into a bundle; and a secondary coil wound around the magnetic core and comprising a third enameled wire and a fourth enameled wire, one end of the third enameled wire with one end of the fourth enameled wire forming a second center tap, the second center tap twisted into another bundle: wherein the transformer has only four enameled wires and the first center tap is cross with the second center tap.

Other objects, advantages and novel features of the invention will become more apparent from the following detailed description when taken in conjunction with the accompanying drawings.

DETAILED DESCRIPTION OF THE PREFERRED EMBODIMENT

Figure 1:
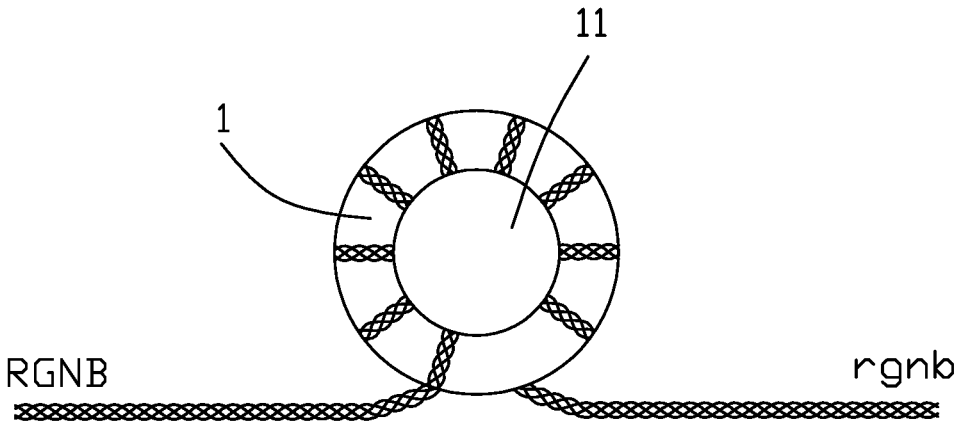
FIG. 1 is a perspective view of four enameled wires wound around the magnetic core of the transformer.

Reference will now be made in detail to the preferred embodiment of the present invention.

Referring to FIGS. 1 to 6, a transformer 100 used for 2.5 Gbps or 5 Gbps Ethernet Networks of filter circuit includes a magnetic core 1, a primary coil 2, and a secondary coil 3 wound around the magnetic core 1.

The magnetic core 1 is annular and has a center through hole 11.

The primary coil 2 comprises a first enameled wire 21 and a second enameled wire 22. The first enameled wire 21 comprises a first thread N and a second thread n, the second enameled wire 22 comprises a first thread B and a second thread b.

The primary coil 3 comprises a third enameled wire 31 and a fourth enameled wire 32, the third enameled wire 31 comprises a first thread R and a second thread r, the fourth enameled wire 32 comprises a first thread G and a second thread g.

Figure 2:
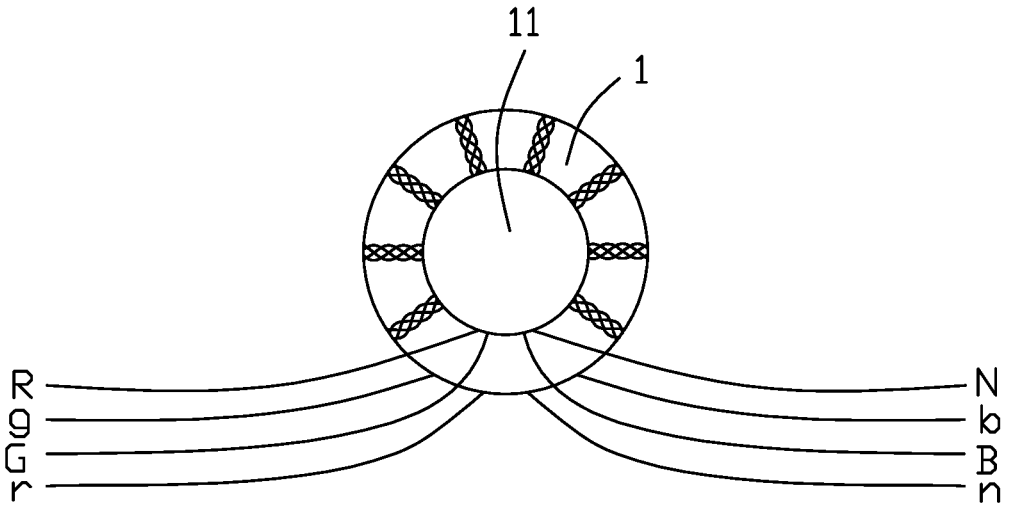
FIG. 2 is a perspective view of four enameled wires of the transformer branched as shown in FIG. 1.
Figure 3:
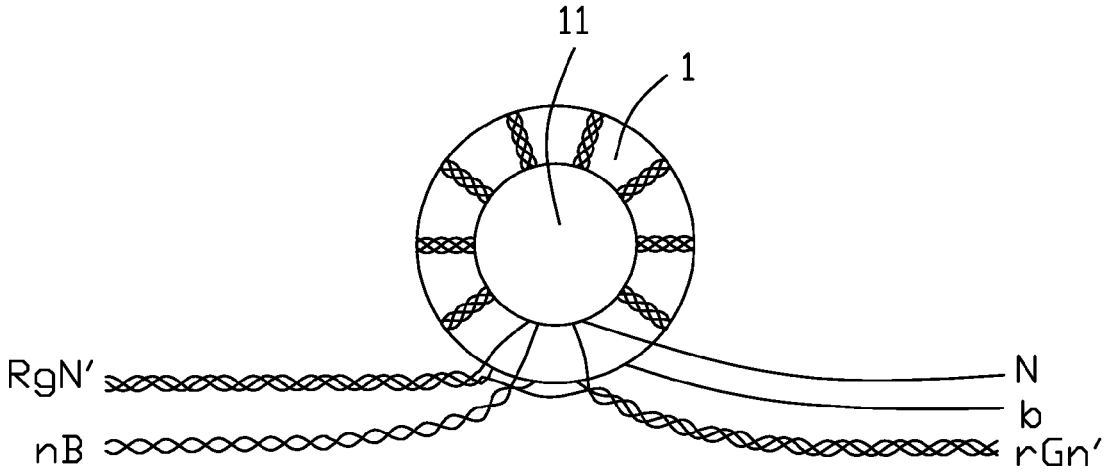
FIG. 3 is a perspective view of four enameled wires of the transformer adding a natural wire and winding their respective ends as shown in FIG. 2.
Figure 4:
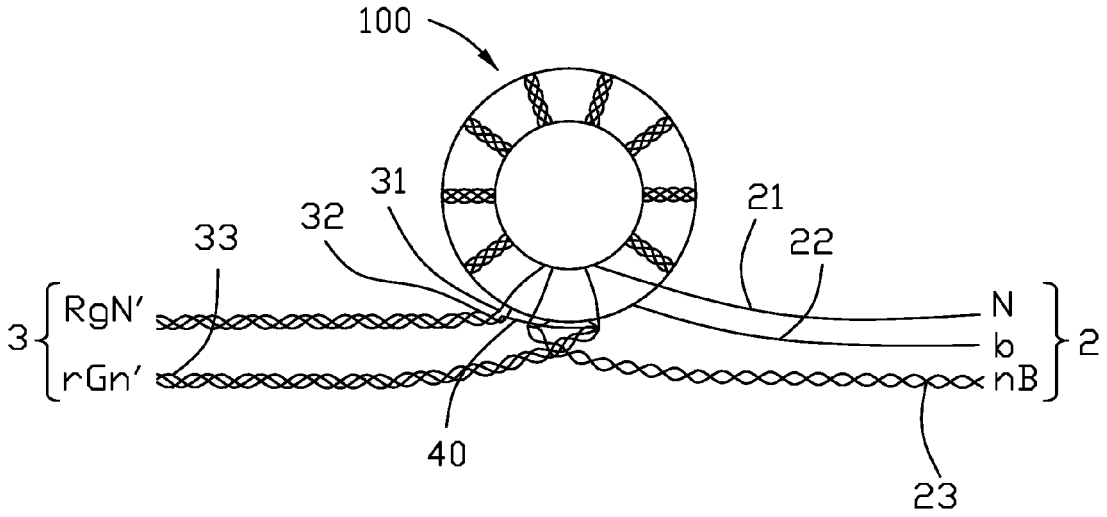
FIG. 4 is a perspective view of center tap of the transformer crossing as shown in FIG. 3.
Figure 5:
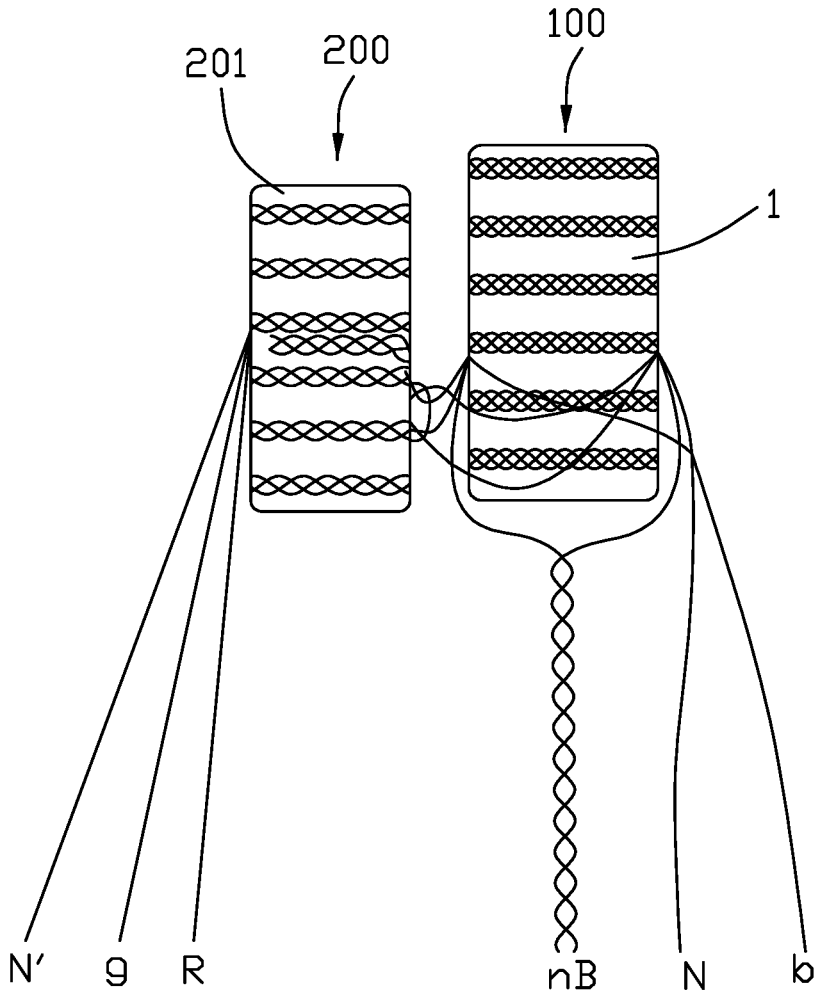
FIG. 5 is a perspective view of filter module applied to transformer as shown in FIG. 4.
Figure 6:
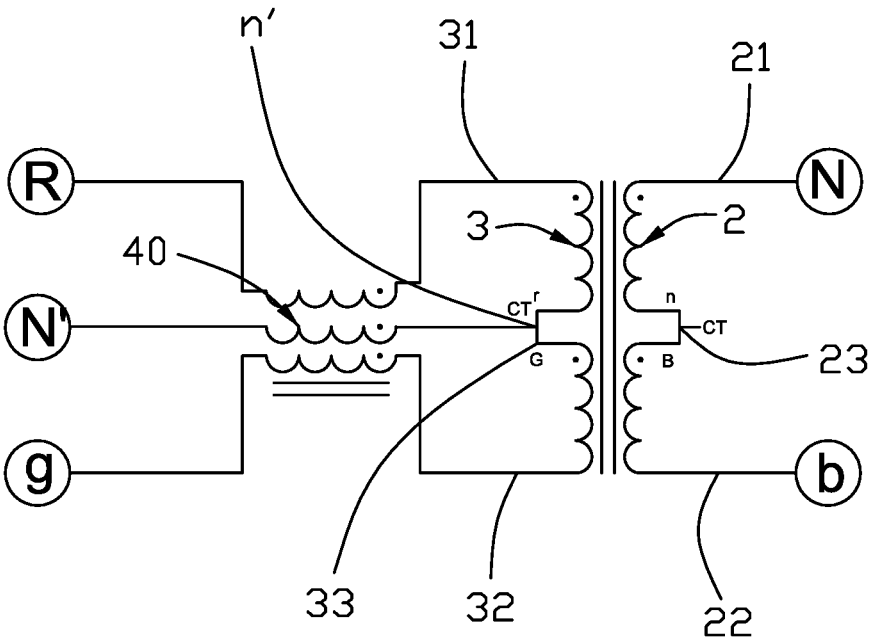
FIG. 6 is a circuit diagram of the filter module as shown in FIG. 5.

Referring to FIG. 2, the first enameled wire 21 is natural, the second enameled wire 22 is blue, the third enameled wire 31 is red, the fourth enameled wire 32 is green. Each part of the enameled wires wound around the magnetic core 1 is twisted together, and wound around the magnetic core 1 in the direction of the through hole 11, the threads of each enameled wire are exposed. The second thread n of the first enameled wire 21 is connected with the first thread B of the second enameled wires 22 to form a first center tap 23. The second thread r of the third enameled wire 31 is connected with the first thread G of the fourth enameled wires 32 to form a second center tap 33. The first center tap 23 twisted into a bundle, the second center tap 33 twisted into another bundle and parallel to the left of the first center tap 23.

Filter module used for Ethernet includes the transformer 100 and a common mode choke 200. The common mode choke 200 includes common core 201. Add a natural wire 40 including a first thread N' and a second thread n'. The natural wire 40, Rg and rG of the transformer 100 twisted around the common mode magnetic core 201, and forming winding RgN' and rGn'. The first center tap 23 is cross-positioned with the second center tap 33. The first center tap 23 extending to left of the left side to be connected with the external element, and the second center tap 33 is short circuited by n'. The first thread N of the first enameled wire 21 and the second thread b of the second enameled wire 22 are respectively used as the input end of the primary coil 2. The first thread R of the third enameled wire 31 and the second thread g of the fourth enameled wire 31 are respectively used as the output end of the secondary coil 3.

Figure 7:
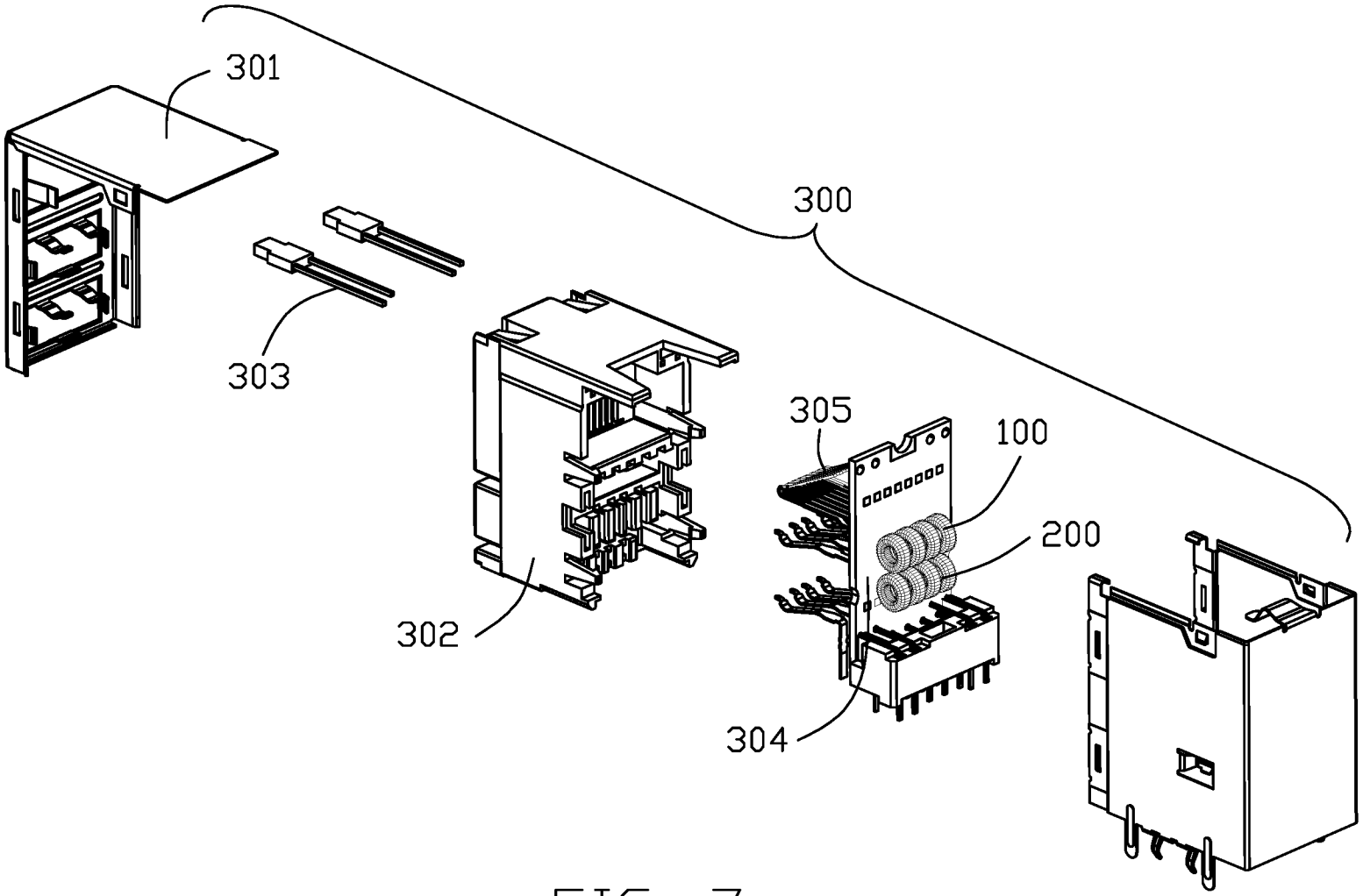
FIG. 7 is an exploded view of the electrical connector.
Figure 8:
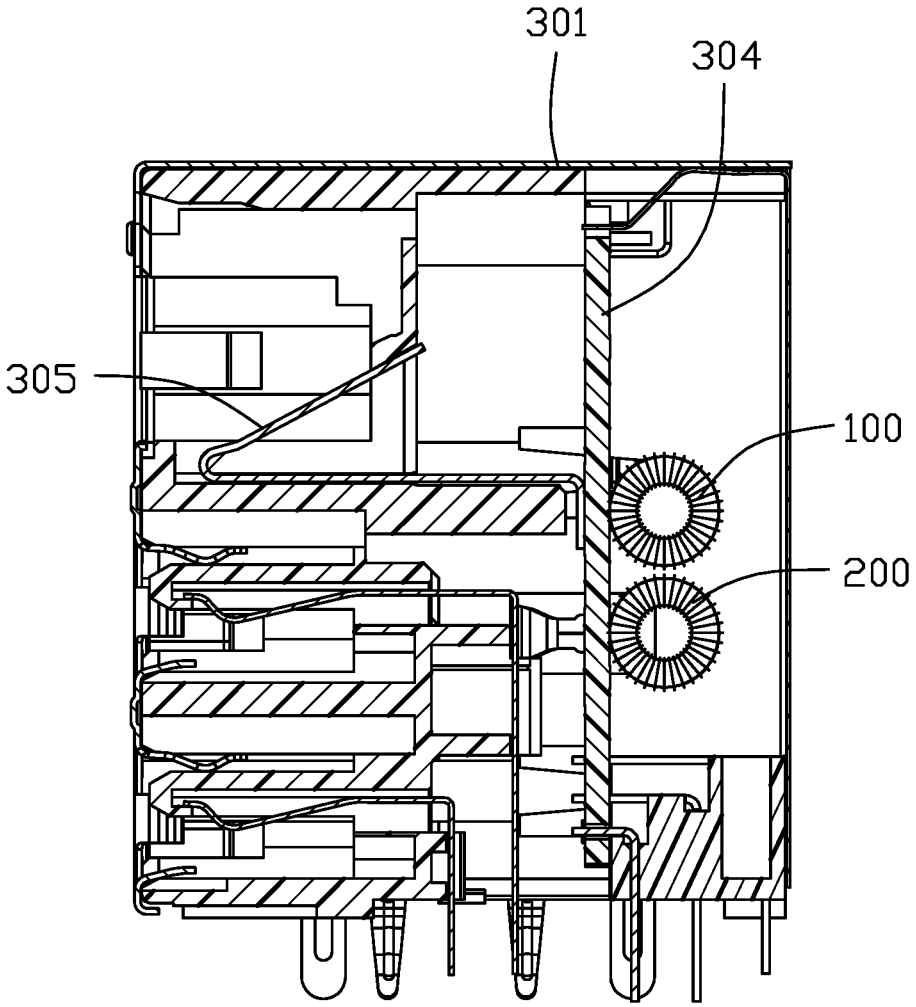
FIG. 8 is across section view of the electrical connector taken along line 8-8 in FIG. 7.

Referring to FIGS. 7 to 8, an electrical connector 300 includes a housing 301, an insulative housing 302 received in the housing 301, a light emitting diode 303 inserted on the upper end of the insulative housing 302, a circuit board 304 received in the insulative housing 302, mating contacts 305 welded on the circuit board 304, and a transformer 100 mounted on the circuit board 304.

The first center tap 23 of the transformer 100 positioned in a cross position with the second center tap 33, which can effectively improve the high frequency characteristics to meet the requirements of the filter circuit of the 2.5 Gbps or the 5 Gbps Ethernet network.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A transformer comprising:

a magnetic core;

a primary coil wound around the magnetic core and comprising a first enameled wire and a second enameled wire, one end of the first enameled wire and one end of the second enameled wire being twisted into a first center tap;

a secondary coil wound around the magnetic core and comprising a third enameled wire and a fourth enameled wire, one end of the third enameled wire and one end of the fourth enameled wire being twisted into a second center tap, the second center tap twisted into another bundle; wherein each of the four enameled wires has a first thread and a second thread extending out of the magnetic core;

the second thread of the first enameled wire is connected with the first thread of the second enameled wire to form the first center tap, and the first thread of the first enameled wire and the second thread of the second enameled wire are respectively used as the input end of the primary coil; and the second thread of the third enameled wire is connected with the first thread of the fourth enameled wire to form the second center tap, and the first thread of the third enameled wire and the second thread of the fourth enameled wire are respectively used as the output end of the secondary coil; and a fifth enameled wire having a first thread and a second thread, the first thread of the fifth enameled wire being twisted with the first thread of the third enameled wire and the second thread of the fourth enameled wire, the second thread of the fifth enameled wire being twisted with the second thread of the third enameled wire and the first thread of the fourth enameled wire; wherein the first center tap is intercrossed with the second center tap.

* * * * *